US005308418A

United States Patent [19]

Björck

[11] Patent Number: 5,308,418

[45] Date of Patent: May 3, 1994

[54] PACKING CONTAINER FOR LIQUID, ESPECIALLY PRESSURIZED CONTENTS

[75] Inventor: Bengt Björck, Lund, Sweden

[73] Assignee: Tetra Laval Holdings & Finance S.A., Pully, Switzerland

[21] Appl. No.: 934,337

[22] Filed: Aug. 25, 1992

Related U.S. Application Data

[60] Division of Ser. No. 703,041, May 16, 1991, Pat. No. 5,219,086, which is a continuation of Ser. No. 482,849, Feb. 22, 1990, abandoned.

[30] Foreign Application Priority Data

Mar. 29, 1989 [SE] Sweden ..... 8901092

[51] Int. Cl.[5] ..... B65B 7/00

[52] U.S. Cl. ..... 156/69; 220/270; 220/359; 220/612; 220/626; 220/906; 229/4.5; 229/123.1; 229/125.15; 156/293; 413/7; 413/18; 413/59

[58] Field of Search ..... 220/359, 270, 266, 265, 220/610, 612, 626, 906, 605, 633, 634, 613, 615, 618; 215/232; 229/4.5, 123.1, 125.15

[56] References Cited

U.S. PATENT DOCUMENTS

| | | | |
|---|---|---|---|
| 898,293 | 9/1908 | Warren . | |
| 3,258,375 | 6/1966 | Ames | 156/69 |
| 3,260,410 | 7/1966 | Brandt et al. | 156/69 X |
| 3,692,202 | 9/1972 | Parlagreco . | |
| 3,700,513 | 10/1972 | Haberhauer et al. | 156/69 |
| 3,750,827 | 8/1973 | Wick . | |
| 3,883,034 | 5/1975 | Rausing . | |
| 3,977,591 | 8/1976 | Martensson . | |
| 4,012,270 | 3/1977 | Fitko . | |
| 4,034,132 | 7/1977 | Manuel . | |
| 4,232,622 | 11/1980 | Weierman et al. | 156/69 X |
| 4,238,050 | 12/1980 | LeGrow . | |
| 4,262,819 | 4/1981 | Hayes . | |
| 4,312,450 | 1/1982 | Reil . | |
| 4,333,585 | 6/1982 | Del Bon . | |
| 4,367,842 | 1/1983 | Rausing . | |
| 4,397,401 | 8/1983 | Ueno et al. . | |
| 4,412,644 | 11/1983 | La Fever . | |
| 4,448,829 | 5/1984 | Köhler | 156/69 X |
| 4,462,732 | 7/1984 | Bloeck . | |
| 4,526,287 | 7/1985 | Miyamatsu et al. . | |
| 4,595,114 | 6/1986 | Lu . | |
| 4,595,116 | 6/1986 | Carlsson . | |
| 4,650,088 | 3/1987 | Hirota et al. . | |
| 4,715,528 | 12/1987 | Kielgaard et al. . | |
| 4,782,646 | 11/1988 | Nantin . | |
| 4,817,816 | 4/1989 | Leseman et al. . | |
| 4,851,062 | 7/1989 | Tartaglione | 156/69 |
| 4,858,782 | 8/1989 | Yasumuro et al. . | |
| 5,016,785 | 5/1991 | Greenebaum, II | 413/7 X |
| 5,041,180 | 8/1991 | Mäkilaakso | 156/69 |

FOREIGN PATENT DOCUMENTS

| | | |
|---|---|---|
| 563284 | 6/1975 | Switzerland . |
| 643790 | 6/1984 | Switzerland . |
| 650210 | 7/1985 | Switzerland . |
| 2157644 | 10/1985 | United Kingdom . |

*Primary Examiner*—Allan N. Shoap
*Assistant Examiner*—Stephen Cronin
*Attorney, Agent, or Firm*—Burns, Doane, Swecker & Mathis

[57] ABSTRACT

A packing container is disclosed in which an end wall of the packing container has an opening formed therein for emptying the contents of the container. The opening in the end wall is covered by a cover strip which is detachably secured to the end wall. The cover strip and the end wall are formed of a plastic coated metallic material and the cover strip is secured to the end wall along a sealing joint that surrounds the opening. The cover strip is secured to the end wall by surface fusion.

4 Claims, 1 Drawing Sheet

PACKING CONTAINER FOR LIQUID, ESPECIALLY PRESSURIZED CONTENTS

This application is a divisional of application Ser. No. 07/703,041, filed May 16, 1991, now U.S. Pat. No. 5,219,086, which is a continuation of application Ser. No. 07,482,849, filed on Feb. 22, 1990, now abandoned.

FIELD OF THE INVENTION

The present invention relates to a packing container. More particularly, the present invention concerns a packing container of non-returnable type for holding liquid which comprises at least one plane end wall, an opening incorporated in the end wall for emptying the liquid and an outer cover strip which is applied over the opening to the outside of the end wall.

BACKGROUND OF THE INVENTION

In packing technology, non-returnable packages of the can type are frequently used for the packaging of liquid, especially pressurized, contents such as beer, refreshing beverages and similar carbonated products. These known can packages generally consist of a cylindrical can body provided with a base, the upper end of the can body being closed with the help of a, substantially, planar end wall which is seamed onto the cylindrical can body. The cylindrical can body generally consists of plastic or metal, e.g. iron or aluminium, whereas the planar end wall as a rule always consists of sheet aluminium.

To make the package conveniently openable, the can is provided in most cases with some type of opening arrangement which on the one hand should make the package readily openable and on the other hand should allow a smooth emptying of the contents from the opened package.

A typical opening arrangement on such known can packages has a weakened or openable part in the planar end wall which by means of a pull-ring fixed to the weakened or openable part is adapted so that it can be completely pulled off to expose an emptying opening through which the contents of the package can be made accessible. One problem not infrequently encountered in this intrinsically simple and in most cases well-functioning opening arrangement is that the openable end wall has to be manufactured from a relatively soft material, preferably aluminium, which is both soft and easy to process, but which from a manufacturing point of view of is very energy consuming and thus cost-demanding metal. In order to make the package more economical, therefore, it is necessary, among other things, to recover and reuse as much as possible of the aluminium content of the package. However, the part of the end wall of the package pulled off during opening of the package, including the pull-ring, is thrown away and, thus, is completely lost after a single use. Added to that is the content that the wasted portion of the end wall represents a substantial environmental problem, since it can remain lying about in nature for a very long time before it breaks down through corrosion, and constitutes during this time, because of its sharp edges, a hazard to humans and animals.

Another opening arrangement on known can packages of the type described above consists of an opening incorporated in the end wall of the drum for emptying the contents which is covered by a cover strip or similar closure device detachably glued onto the outside of the end wall. This known opening arrangement is relatively simple and easy to manufacture and as a rule functions well, but it has the disadvantage, among other things, especially in the case of can packages for pressurized contents, that it requires environmentally doubtful and expensive glue to provide the joint between the cover strip and the package end wall with the required tightness and durability.

OBJECTS AND SUMMARY OF THE INVENTION

The abovementioned inconveniences are overcome in accordance with the present invention where a packing container of the aforementioned includes a cover strip and an end wall that are made of a material comprising a layer of metal and at least one outer coating of weldable plastics material. The cover strip is connected to the end wall along a sealing joint around the whole emptying opening. The sealing joint is liquid-tight, but is breakable to permit the contents to be emptied. The sealing joint is formed by surface fusion of the plastic coatings facing one another on the cover strip and the end wall respectively.

In accordance with a particularly preferred embodiment of the invention the sealing joint between the cover strip and the end wall of the package is produced by inductive heating in a known manner of the metal layers incorporated in the cover strip and the end wall respectively. That method has been found to permit the package to be closed in a rapid and simple manner while also permitting the actual closing process to be easily monitored both with regard to the heating period and the temperature and that way the sealing joint will be tighter and more durable than, for example, in the case of gluing.

BRIEF DESCRIPTION OF THE DRAWINGS

The invention will now be described in greater detail with special reference to the attached drawing, wherein.

DETAILED DESCRIPTION OF THE PREFERRED EMBODIMENT

Figure 1:
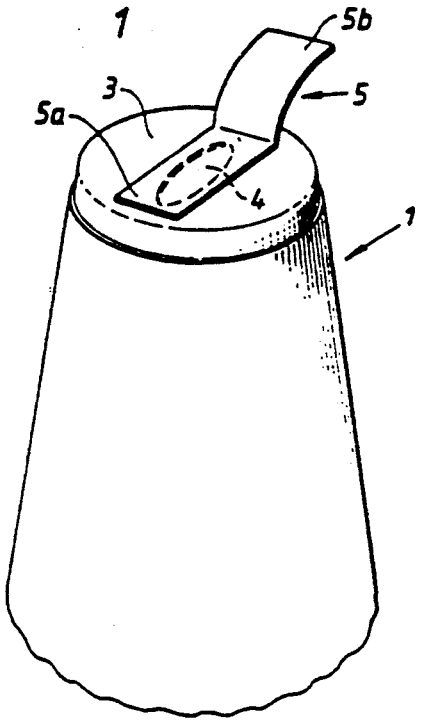
FIG. 1 is a perspective view of the top part of a packing container provided with an opening arrangement in accordance with the invention.

Although the invention can be applied to all packages of the can type, it is assumed in the embodiment referred to here that the package, which has been given the general reference designation 1, is of the type which is shown in FIG. 1 and which consists of an upwards tapering can body 2 provided with any kind of bottom closure and a substantially planar end wall 3 arranged at the upper open end of the can body. The end wall 3 has an emptying opening 4 incorporated beforehand which is covered on the top by means of an outer cover strip 5 applied to the outside of the end wall. The cover strip 5 comprises a mounting part **5*a*, which is connected detachably to the end wall 3 over the emptying opening 4, and a readily accessible gripping part 5*b* by means of which the cover strip 5** is adapted to be removed on opening of the package.

Figure 2:
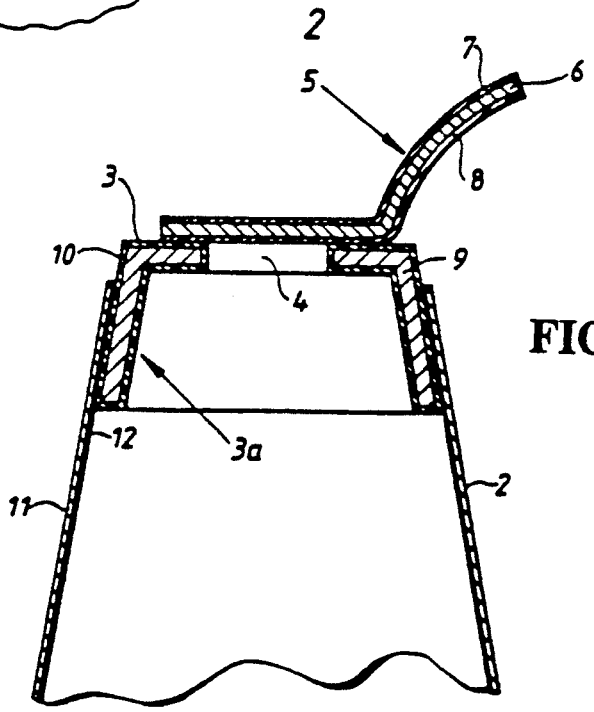
FIG. 2 is a cross-sectional view of the top part of the container shown in FIG. 1.

As is evident more clearly from FIG. 2, the cover strip 5 is manufactured from a laminated material comprising a central layer of material strong in tension, e.g. iron, and outer coatings 7 and 8 of weldable plastic material, e.g. polyester (preferably polyethylene terephthalate). FIG. 2 further illustrates that the end wall 3 too is manufactured from a material comprising a central metallic layer 9 with an outer coating 10 of weldable plastics material, e.g. polyester (preferably polyethylene terephthalate). The end wall 3 has a downwards directed edge portion 3*a* serving as a fastening means which extends unbroken around the whole periphery of the end wall and which, at least partially, is inserted in, and is fastened to, the inside of the can body 2 along a liquid-tight and mechanically durable sealing joint around the whole thus inserted part of the edge portion 3*a* of the end wall.

As pointed out earlier, it is important that the joint between the outer cover strip 5 and the end wall 3, should be sufficiently strong to be able to withstand the internal pressure of the package, which in the case of contents such as beer, refreshing beverages and similar carbonated drinks may rise to approx. 7 bar. On the other hand, the joint should not be so strong that upon opening of the package, an intentional pulling off of the cover strip is made impossible or is made unnecessarily difficult. In accordance with the invention a desirable optimum joint is obtained in that the cover strip 5 and the end wall 3 are connected to one another along a sealing joint formed by surface fusion between the plastic coatings 8 and 10 respectively facing one another, and it has been found in particular that a sealing joint which functions well and is easily controllable can be obtained if the cover strip 5 and the end wall 3 are joined to one another by inductive heating of the metal layers 6 and 9 incorporated in the cover strip 5 and the end wall 3 respectively. Such an inductive heat sealing is both rapid and simple and can be carried out with the help of existing conventional equipment. The method, among other things, has the further advantage that it can be easily monitored both with regard to the heating period and to the temperature, so that a mechanically durable sealing joint which is liquid-tight but easily breakable is obtained around the whole emptying opening 4.

The can body 2, which preferably is of the conical shape indicated in FIGS. 1 and 2, is also manufactured appropriately from a material comprising a thin inner metal layer 11 and at least one outer coating 12 of weldable plastic material, preferably polyethylene terephthalate, facing towards the inside of the package, as a result of which the joint between the inserted part of the edge portion 10 of the end wall 3 and the inner plastic coating 12 of the container body 2 can also be achieved by inductive heating in a manner known in itself.

While this invention has been illustrated and described in accordance with a preferred embodiment, it is recognized that variations and changes may be made and equivalents employed herein without departing from the invention as set forth in the claims.

What is claimed is:

1. A method of forming an opening arrangement on a container, comprising the steps of:

forming a container having an end wall located at one end thereof, said end wall including a metal layer, forming an opening in the end wall so that said opening is defined by an inner peripheral wall that extends between upper and lower surfaces of said end wall, applying a coating of weldable plastic material to the metal layer of the end wall so that the coating of weldable plastic material is in contact with the metal layer on at least one side of the metal layer and so that the coating of weldable plastic material covers substantially the entire inner peripheral wall of the opening;

providing a cover strip formed of a metal layer and a coating of weldable plastic material in contact with the metal layer on at least one side of the metal layer; and sealing the cover strip to the end wall by sealing the coating of weldable plastic material of the cover strip directly to and in contact with the coating of weldable plastic material of the end wall, and cover strip being sealed to the end wall such that the cover strip covers the opening in the end wall.

2. The method according to claim 1, wherein said container is formed with a hollow body having a side wall that is shaped to define an interior and to form an opening, said side wall of said hollow body being made of a metal layer and a coating of plastic material on at least a side of the metal layer that faces the interior of the body; said end wall including an end wall member having a substantially flat end wall portion and an edge portion integrally formed therewith and extending therefrom, said edge portion being formed of a metal layer having an outwardly facing surface and a coating of plastic material entirely covering the outwardly facing surface of the metal layer; and sealing said coating of plastic material on the side wall of the body to said coating of plastic material on the edge portion of the end wall member so that the end wall portion of the end wall member defines the end wall of the container.

3. The method according to claim 1, wherein said coating of weldable plastic material on the cover strip is sealed to said coating of weldable plastic material on the end wall through induction heating.

4. The method according to claim 1, wherein said cover strip includes a mounting part and a gripping part, said mounting part having outermost portions adjacent the periphery and wherein said step of sealing the cover strip to the end wall includes sealing said outermost portions of the mounting part to the end wall.

* * * * *